US012085091B2

(12) United States Patent
Peyton et al.

(10) Patent No.: US 12,085,091 B2
(45) Date of Patent: Sep. 10, 2024

(54) CEILING FAN HANGER ASSEMBLY

(71) Applicant: Hunter Fan Company, Memphis, TN (US)

(72) Inventors: Dwayne Peyton, Antoich, TN (US); Alexander Douglass Pettey, Antoich, TN (US); Daniel Rice, Thompson's Station, TN (US)

(73) Assignee: Hunter Fan Company, Memphis, TN (US)

( * ) Notice: Subject to any disclaimer, the term of this patent is extended or adjusted under 35 U.S.C. 154(b) by 0 days.

(21) Appl. No.: 17/811,103

(22) Filed: Jul. 7, 2022

(65) Prior Publication Data

US 2024/0011505 A1 Jan. 11, 2024

(51) Int. Cl.
*F04D 25/06* (2006.01)
*F04D 19/00* (2006.01)
*F04D 29/64* (2006.01)

(52) U.S. Cl.
CPC ..... *F04D 29/644* (2013.01); *F04D 19/002* (2013.01); *F04D 25/06* (2013.01)

(58) Field of Classification Search
CPC ..... F04D 25/06; F04D 19/002; F04D 29/644
See application file for complete search history.

(56) References Cited

U.S. PATENT DOCUMENTS 2,242,840 A * 5/1941 Warden, Sr. ..... B05B 15/622 248/83
2,806,722 A * 9/1957 Atkins ..... E04H 12/182 403/109.5
4,576,501 A * 3/1986 McConnell ..... F16B 7/1472 403/104
4,818,135 A * 4/1989 Desjardins ..... F16B 7/1472 403/104
5,090,654 A * 2/1992 Ridings ..... F16M 11/2078 403/90
5,540,017 A * 7/1996 Eilam ..... E04H 12/182 52/118
6,382,917 B1 * 5/2002 Zuege ..... F04D 25/088 416/210 R
6,443,702 B1 9/2002 Ross
D480,464 S 10/2003 Liu
D483,854 S 12/2003 Stauffer
6,662,983 B2 12/2003 Lane et al.
(Continued)

FOREIGN PATENT DOCUMENTS

CN 202926675 U * 5/2013
CN 304546552 3/2018
(Continued)

OTHER PUBLICATIONS https://www.menards.com/main/lighting-ceiling-fans/ceiling-fans/industrial-ceiling-fans/hunter-reg-industrial-xp-anodized-black-indoor-hvis-ceiling-fan/72121/lighting-ceiling-fans/ceiling-fans/industrial-ceiling-fans/hunter-reg-industrial-xp-anodized-black-indoor-hvls-ceiling-fan/72125/p-1525415400463.htm, Hunter Industrial XP 14' 110-Volt Single Phase Anodized Black Indoor Ceiling Fan, Model No. 72125, accessed Jan. 14, 2021.
(Continued)

*Primary Examiner* — Thomas Fink
(74) *Attorney, Agent, or Firm* — McGarry Bair PC

(57) ABSTRACT

A ceiling fan hanger assembly includes a mount plate and a downrod having an inner and an outer portion. The inner and outer portions of the downrod are slidably engaged and can be fastened together to extend or shorten the length of the downrod.

10 Claims, 8 Drawing Sheets

(56) References Cited

U.S. PATENT DOCUMENTS

| | | | | |
|---|---|---|---|---|
| 7,143,988 | B2 | 12/2006 | Blateri | |
| 8,827,664 | B2 * | 9/2014 | McCloud | F04D 25/0606 417/423.15 |
| D716,437 | S | 10/2014 | Salisbury et al. | |
| 9,151,514 | B2 * | 10/2015 | Arnold, III | F24F 13/32 |
| 9,382,918 | B2 | 7/2016 | Kuramochi et al. | |
| 9,982,679 | B2 * | 5/2018 | Santolucito | F04D 25/062 |
| D856,503 | S | 8/2019 | Santolucito et al. | |
| 10,648,485 | B2 | 5/2020 | Santolucito et al. | |
| 2002/0085919 | A1 * | 7/2002 | Ross | F04D 25/088 416/246 |
| 2003/0202882 | A1 * | 10/2003 | Tang | F16M 13/027 416/246 |
| 2008/0193294 | A1 * | 8/2008 | Grant | F24F 7/007 416/204 R |
| 2009/0072108 | A1 * | 3/2009 | Oleson | F16M 11/10 248/282.1 |
| 2009/0129974 | A1 * | 5/2009 | McEllen | A61L 9/205 422/108 |
| 2009/0258520 | A1 * | 10/2009 | Smith | H01R 13/5219 439/271 |
| 2010/0218992 | A1 * | 9/2010 | Smith | H01R 4/643 174/84 R |
| 2017/0167509 | A1 * | 6/2017 | Selig | F04D 29/329 |
| 2020/0063752 | A1 | 2/2020 | Ebersole et al. | |
| 2020/0318648 | A1 * | 10/2020 | Wiegel | F04D 29/263 |
| 2020/0362910 | A1 * | 11/2020 | Zhang | F16C 11/0695 |
| 2023/0118465 | A1 * | 4/2023 | Zhang | F04D 29/646 416/244 R |

FOREIGN PATENT DOCUMENTS

| | | | |
|---|---|---|---|
| CN | 304573140 | S | 4/2018 |
| CN | 208106837 | U * | 11/2018 |
| CN | 216008955 | U * | 3/2022 |
| KR | 101578043 | B1 * | 12/2015 |

OTHER PUBLICATIONS https://www.menards.com/main/lighting-ceiling-fans/ceiling-fans/indoor-ceiling-fans/litex-braswell-56-chrome-indoor-ceiling-fan/br56tbc3m/p-1547278329540-c-7488.htm?tid=9008175418232849340&ipos=38, Litex Braswell 56" Chrome Indoor Ceiling Fan, Model No. BR56TBC3M, accessed Jan. 14, 2021.

https://www.industrialfansdirect.com/products/hunter-ecohvis-networked-control-ceiling-fan-10-foot-2500-sq-ft-coverage-3-phase-460v-72271-hunter-industrial, Hunter ECO HVLS Networked Control Ceiling Fan 10 Foot 2500 Sq Ft Cover, Model No. 72271, accessed Jan. 14, 2021.

https://www.luminancebrands.com/fans/indoor/hf956bq.html, Emerson 56 In Industrial Ceiling Fan, Model No. HF956BQ, accessed Dec. 16, 2020.

https://www.minkagroup.net/f624-cl.html, Minka Roto XL 62" 3-Blade Ceiling Fan, Model No. F624-CL.

https://www.minkagroup.net/f729-bn.html, Minka Steal 54" Ceiling Fan, Model No. F729-BN, accessed Dec. 16, 2020.

https://www.dansfancity.com/tornado-72-stainless-steel-industrial-ceiling-fan, Tornado 72 in. Stainless Steel S316 Industrial Ceiling Fan, SKU 72tor_ss, accessed Jan. 14, 2021.

https://www.craftmadelightinglights.com/product/craftmade-windswept-outdoor-fans-wnd120bnk6.html, Craftmade Windswept 78" Ceiling Fan with Blades, Model No. WND78BNK6, accessed Dec. 16, 2020.

https://www.bigassfans.com/fans/essence/, Big Ass Fans Essence, accessed Jan. 14, 2021.

https://www.lightology.com/index.php?module=prod_detail&prod_id=955691, Lightology, Arteriors Downrod Square 18 InchM, accessed Nov. 3, 2020.

https://www.indiamart.com/neo-grano-tech/products.html#adjustable-fan-downrod, Indiamart, Neo Grano Tech, accessed Nov. 3, 2020.

* cited by examiner

CEILING FAN HANGER ASSEMBLY

BACKGROUND

Ceiling fans are used to generate airflow within a space or area, often used for cooling or temperature regulation. Ceiling fans can be used in industrial, commercial or other suitable environments to circulate air to maintain proper temperature regulation. Often, the ceiling fan is suspended from the ceiling of a building structure, or other structural elements of the building structure at the ceiling, such as beams or girders for example.

Suspension of the ceiling fan includes mounting a portion of the ceiling fan, such as a mounting bracket, to the ceiling or building structural elements. The remainder of the ceiling fan is then coupled to the mounting bracket and suspended within the area at an appropriate height from the floor. Often, determining the appropriate height can be challenging for an installer. Furthermore, if the ceiling or building structure is provided at an angle, the suspension of the ceiling fan must account for such an angle.

BRIEF DESCRIPTION

In one aspect, the disclosure relates to a ceiling fan assembly comprising a ceiling mount structure, a motor assembly having a rotating blade hub, and an adjustable downrod assembly connecting the motor assembly to the ceiling mount structure, the adjustable downrod assembly comprising an upper rod connected to the ceiling mount structure, a lower rod connected to the motor assembly and configured to telescopingly slide relative to the upper rod, and at least two fasteners positioned around the periphery of one of the upper or lower rods and configured to secure the upper rod to the lower rod.

In another aspect, the disclosure relates to a ceiling fan assembly comprising a ceiling mount structure, a motor assembly having a rotating blade hub, and a downrod assembly comprising a telescoping rod having a hollow interior connecting the motor assembly to the ceiling mount structure and at least two fasteners positioned around the periphery of the telescoping rod to secure the telescoping rod in a fixed position.

DETAILED DESCRIPTION

Figure 1:
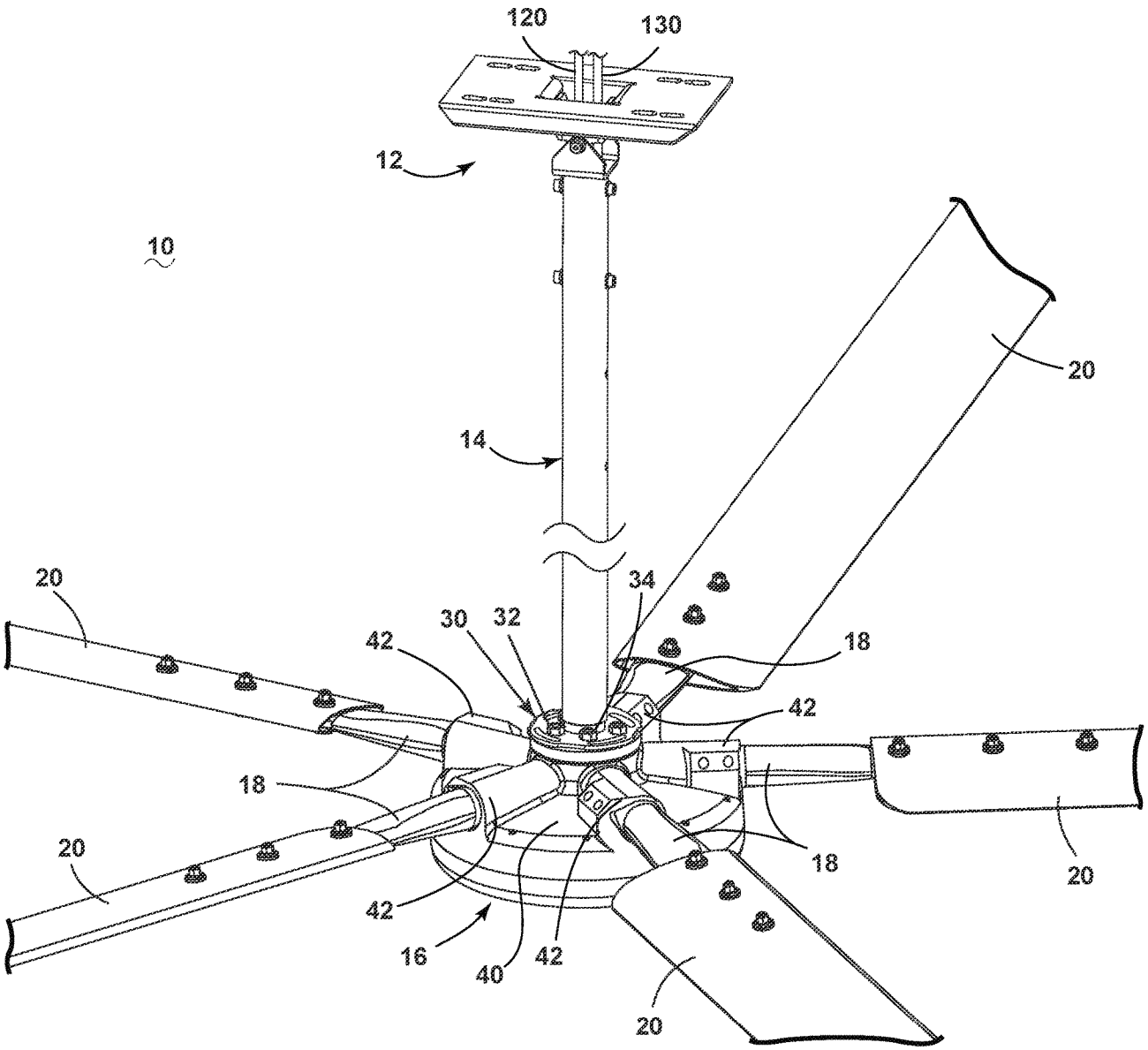
FIG. 1 is a view of a ceiling fan with a downrod mount assembly and an extendable downrod.

The description herein is directed to systems, methods, and other devices related to a ceiling fan. More specifically, the description relates to a ceiling fan downrod assembly for suspending a ceiling fan. The ceiling fan downrod assembly provides for an adjustable length of the downrod for the ceiling fan to hang or suspend from a structure. The ceiling fan downrod assembly further provides for simplification of adjustment of assembly and installation, as the ceiling fan downrod assembly can facilitate installation of the ceiling fan at the desired height.

As used herein, the term "set" or a "set" of elements can be any number of elements, including only one. All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, connected, and joined) are to be construed broadly and can include intermediate members between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary.

FIG. 1 illustrates a top perspective view of a ceiling fan 10 including a ceiling fan hanger assembly 12 for mounting to a ceiling (not shown) or a structure. The ceiling fan includes a downrod 14, a motor assembly 16, a set of blade holders 18, and a set of blades 20. An adapter assembly 30 can couple the downrod 14 to the motor assembly 16, and can include an adapter plate 32 provided at the end of the downrod 14 configured to mount to the motor assembly 16, a motor shaft (not shown), or any other attachment member configured to suspend the motor assembly 16 from the downrod 14. In one example, a set of fasteners 34 can be utilized to couple the adapter plate 32 to the motor assembly 16.

The motor assembly 16 can include a housing 40. A set of blade hubs 42 can be provided on the housing 40. The set of blade hubs 42 can be configured to receive and couple to the set of blade holders 18, which can be used to couple the blades 20 to the motor assembly 16 for rotatably driving the blades 20. The motor assembly 16 can house a motor (not shown) such as a permanent magnet type motor including a stator and a rotor in one non-limiting example. A supply of power can be used to drive the rotor about the stator to rotate the motor housing 40, and thereby rotating the blades 20 coupled to the motor housing 40 via the blade holders 18. A safety cable 120 and an electrical wire 130 can be threaded through the ceiling fan hanger assembly 12 and the downrod 14.

Figure 2A:
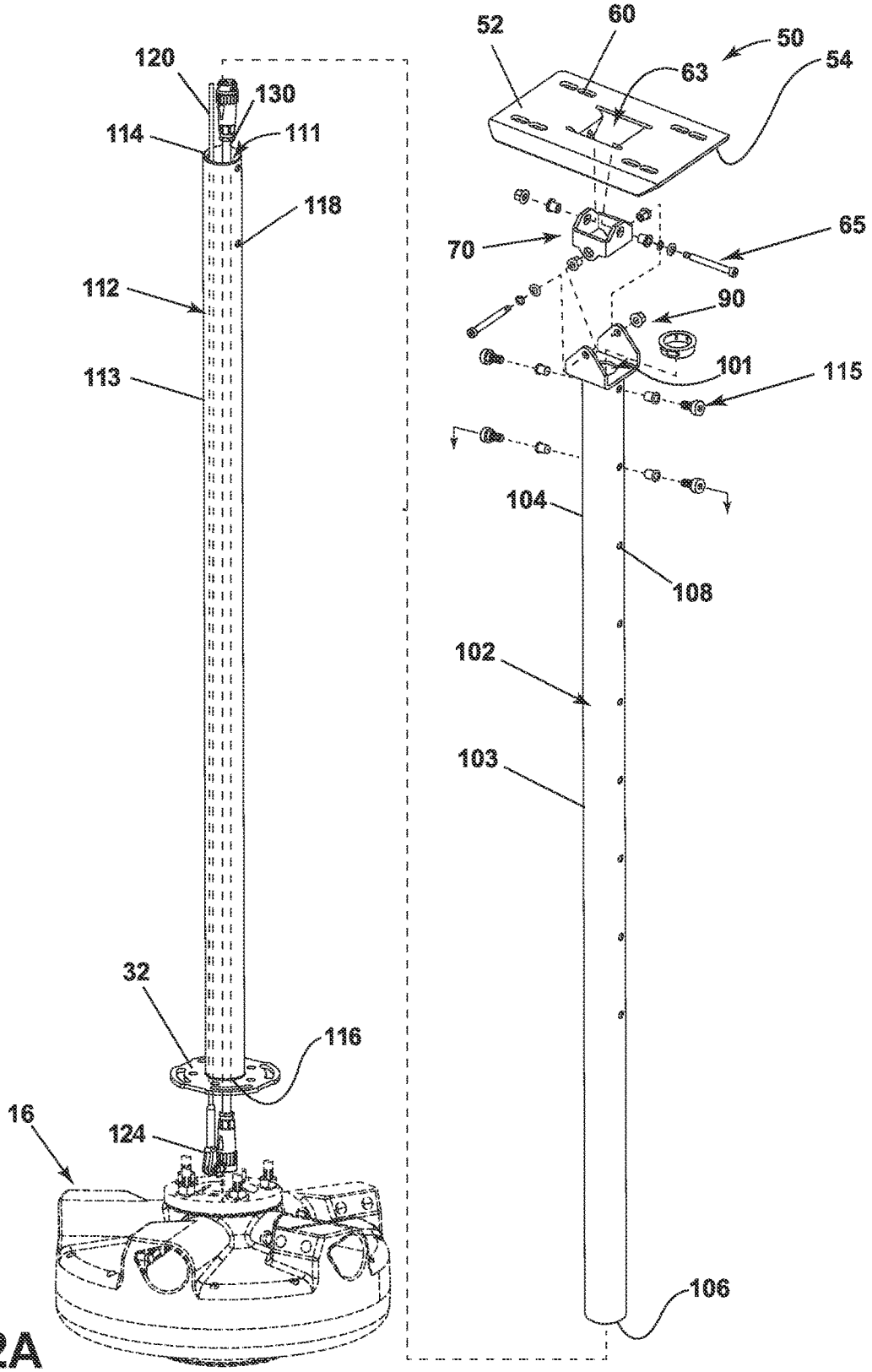
FIG. 2A is an exploded view of the ceiling fan hanger assembly and downrod of FIG. 1.

Referring now to FIG. 2A, the ceiling mount structure or ceiling fan hanger assembly 12 includes a mount plate 50, a connector bracket 70, and a downrod mount 90. The mount plate 50 includes a set of apertures 60. While the set of apertures 60 are shown herein as including eight apertures, with two apertures in each corner, any suitable number and arrangement of apertures 60 is contemplated, as may be suitable for manufacture, structural integrity of the mount plate, or overall weight reduction. The mount plate 50 includes a cable opening 63 near the center of the mount plate 50. The connector bracket 70 provides for connecting the mount plate 50 to the downrod mount 90 via rounded fasteners 65. The downrod mount 90 can have a bottom wall 92 with an opening. A removable bushing 96 can be included in the opening.

The downrod 14 can be a telescoping rod including at least an upper rod 102 and a lower rod 112. The upper rod 102 can be hollow with an interior 101. The upper rod 102 can be formed as a tube with a round shape or any shape having edges and corners, in non-limiting examples. The upper rod 102 can include a first end 104 and a second end 106, with a wall 103 extending therebetween. A set of outer openings 108 can be spaced along the upper rod 102. The set of outer openings 108 can be spaced linearly along the length of the upper rod 102, however alternative spacing patterns are contemplated, such as a spiral pattern. In one non-limiting example the set of outer openings 108 can be spaced on opposite sides of the upper rod 102. Additionally, and alternatively, the set of outer openings 108 can be circumferentially spaced about the upper rod 102.

The downrod 14 can include a lower rod 112. The lower rod 112 can be hollow with an interior 111. The lower rod 112 can be formed as a tube with shape complementary to the shape of upper rod 102. As illustrated, the lower rod 112 has a smaller diameter than the upper rod 102 and is sized to fit concentrically within the upper rod 102. The lower rod 112 can include a upper end 114 and a lower end 116, with a wall 113 extending therebetween. The lower end 116 of the lower rod 112 can be connected to the adapter plate 32 and configured to mount to the motor assembly 16. It should be recognized that in other non-limiting examples, the lower rod 112 can have a larger diameter than the upper rod 102 for telescoping engagement.

A set of inner openings 118 can be included in the lower rod 112. The set of inner openings 118 can be arranged at or near the upper end 114. As shown, the set of inner openings 118 includes two openings, however it is contemplated that the set of inner openings 118 can include any number of openings. The spacing of the set of inner openings 118 can match the spacing of the set of outer openings 108. The set of inner openings 118 can be spaced linearly along the length of the lower rod 112, however it should be appreciated that other spacings of the set of inner openings 118 can be utilized, such as circumferential spacing about the periphery of lower rod 112, spiral, or offset spacing. The spacing, or distance between the sets of inner and outer openings 108, 118 can be about 1 inch. Additionally, or alternatively, the spacing can be between about 2 inches and about 12 inches. The inner and outer openings 108, 118 can receive a set of fasteners 115. The diameter of each opening of the sets of inner and outer openings 108, 118 can be about 0.5 inches. Alternatively, the openings 108, 118 can have any diameter appropriate to the fastener 115.

The safety cable 120 can extend unobstructed through the upper rod 102 and the lower rod 112. At least one end of the safety cable 120 can include a clevis 124. The electrical wire 130 can extend unobstructed through the upper rod 102 and the lower rod 112. The safety cable 120 and the electrical wire 130 extend through the cable opening 63 in the mount plate 50, through the center of the connector bracket 70, and through the center of downrod mount 90. At the lower end 116, the safety cable 120 and the electrical wire 130 extend through the adapter plate 32.

Figure 2B:
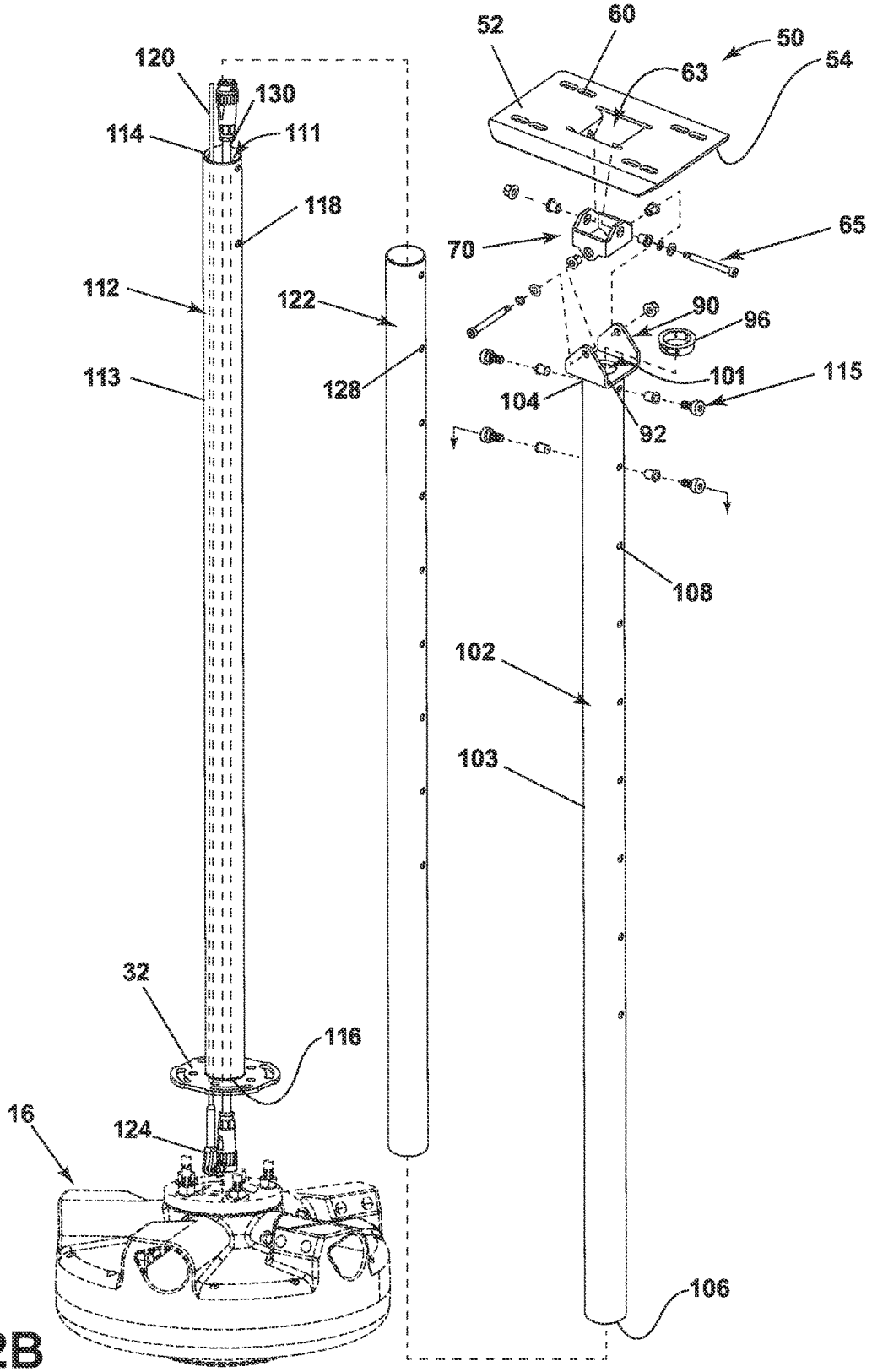
FIG. 2B is an exploded view of the ceiling fan hanger assembly of FIG. 1 with another downrod, according to an aspect of the disclosure herein.

Turning now to FIG. 2B, the downrod 14 can include at least one additional rod between the upper rod 102 and the lower rod 112. For example, a middle or third rod 122 with openings 128 can be included in downrod 14. The openings 128 can be spaced according to the spacing of openings 108 and 118 to receive fasteners 115. The third rod 122 can have a diameter intermediate between the diameters of the upper rod 102 and the lower rod 112. It should be appreciated that in other non-limiting examples, the upper rod 102, third rod 122, and lower rod 112 can have any combination of diameters that supports telescoping engagement. For example, the diameter of the third rod 122 can be smaller than the diameter of the lower rod 112 and larger than the diameter of the upper rod 102.

Figure 3:
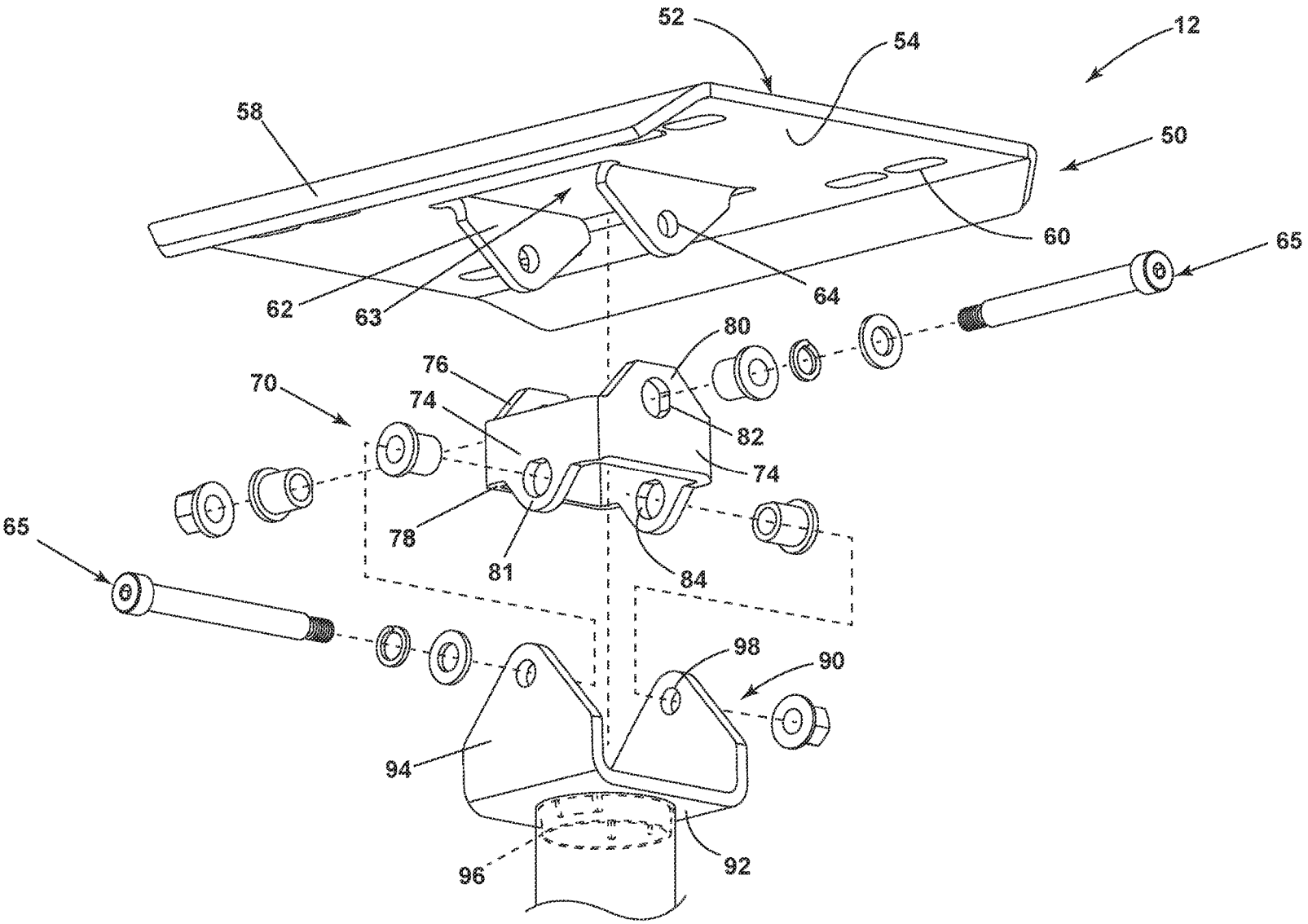
FIG. 3 is an exploded view of the ceiling fan hanger assembly of FIG. 1.

Referring now to FIG. 3, the mount plate 50, connector bracket 70 and downrod mount 90 are shown in more detail. The mount plate 50 includes an upper surface 52 and a lower surface 54. The mount plate 50 further includes a pair of plate extensions 62. The mount plate 50 further includes a pair of flanges 58. The pair of flanges 58 are formed as angled portions of the mount plate 50, offset from the planar surface of the remainder of the mount plate 50. As shown, the pair of flanges 58 angle in the direction of the lower surface 54 of the mount plate 50, while other configurations are contemplated, such as angling toward the upper surface 52.

The plate extensions 62 can be described as a pair of plate extensions 62 that are arranged parallel to one another, and can be shaped similar or identical to one another, while it is contemplated that the plate extensions 62 can be shaped differently from one another or oriented in a different arrangement. The plate extensions 62 can extend perpendicular from the lower surface 54 of the mount plate 50. Each plate extension 62 can include an aperture 64. The plate extensions 62 can be welded to the mount plate 50, for example, or can be stamped as a part of the mount plate 50 and bent into the position as shown in FIG. 3. The cable opening 63 in the mount plate 50 can be located between the plate extensions 62.

The connector bracket 70 includes a set of four sidewalls 74 to define a square cross-sectional profile taken perpendicular to each of the sidewalls 74, while any number of sidewalls is contemplated. Each sidewall 74 terminates at a top edge 76 and bottom edge 78. Two opposing sidewalls 74 of the set of sidewalls 74 include a top tab 80 at least partially forming the top edge 76. The two remaining opposing sidewalls 74 of the set of sidewalls can include a pair of bottom tabs 81. The top tabs 80 are arranged such that two opposing sidewalls 74 each include a top tab 80 extending from the top edge 76, and the remaining two opposing sidewalls 74 each include one bottom tab 81 extending from the bottom edge 78. Each top tab 80 includes an upper opening 82 located adjacent to the top edge 76. Each bottom tab 81 includes a lower opening 84 located adjacent the bottom edge 78. The upper openings 82 can be spaced complementary to the apertures 64 on each plate extension 62. As shown, the upper and lower openings 82, 84 can be rounded, while any suitable shape is contemplated, such as polygonal in one non-limiting example.

The downrod mount 90 can include a bottom wall 92 sized to be larger than the diameter of the downrod 14 such that the bottom wall 92 extends radially wider than the remainder of the downrod 14. A pair of downrod extensions 94 can extend from the bottom wall 92 opposite the downrod 14. The downrod extensions 94 can be arranged parallel to one another, and can be substantially planar members. The downrod extensions 94 can be identical to one another, while it is contemplated that each extension can be unique or can be arranged non-parallel to one another. A set of downrod extension apertures 98 can be included in downrod mount 90, where each downrod extension 94 includes at least one of the set of downrod extension apertures 98. The apertures 64, upper and lower openings 82, 84, and downrod extension apertures 98 can have a rounded or circular shape adapted to receive the rounded fasteners 65.

The bottom wall 92 can include an opening with the removable bushing 96 aligned with the hollow interior 101 of the upper rod 102. The bushing 96 can be sized complementary to the interior of the downrod 14, and can be used to provide a smoother surface for items passing into the interior of the downrod 14, such as electrical wiring, for example. The downrod mount 90 and the upper rod 102 of downrod 14 can be a one-piece assembly, such as cast or formed integral with one another, and can be a monolithic or unitary structure, while it is contemplated that the downrod mount 90 affixes to the downrod 14, such as by welding, for example.

Figure 4:
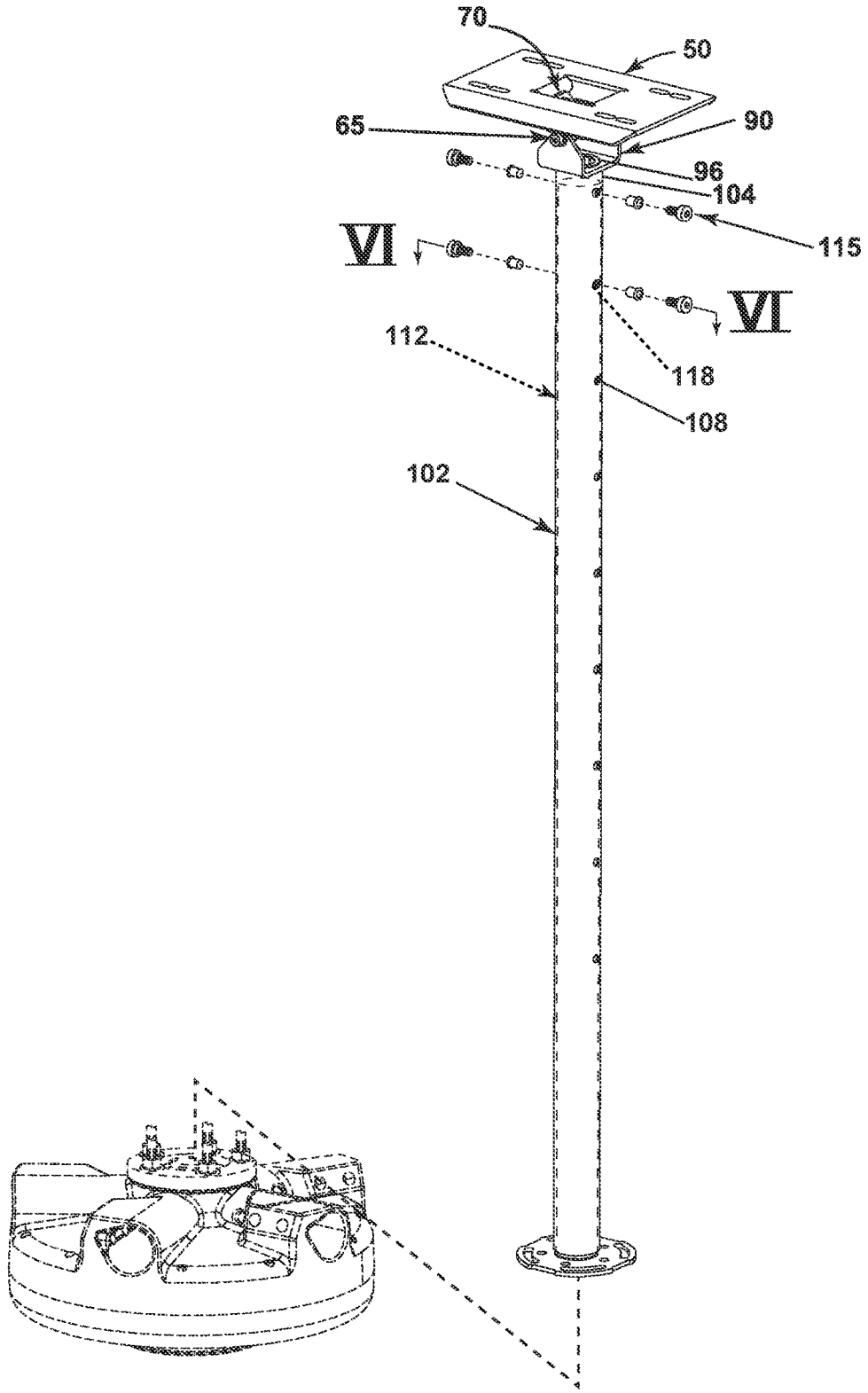
FIG. 4 is a view of the downrod of FIG. 1 in a first configuration.

Referring now to FIG. 4, the downrod 14 is shown in a collapsed configuration, according to an aspect disclosed herein. The mount plate 50, connector bracket 70, and downrod mount 90 are pivotably connected with rounded fasteners 65. The first end 104 of the upper rod 102 can be fixed to the ceiling fan hanger assembly 12 at the downrod mount 90. In one non-limiting example, the bushing 96 can extend into the interior 101 of the upper rod 102. The lower rod 112 can be secured inside upper rod 102 with a set of fasteners 115 positioned around the periphery of one of the upper rod 102 or lower rod 112. In one non-limiting example, the set of fastener 115 can include screw-nut pairs, however it should be appreciated that any kind of reasonable fastener can be used such as set screws.

In the collapsed configuration, the upper rod 102 and lower rod 112 are positioned such that the upper-most openings of the set of openings 108 of the upper rod 102 are aligned with the openings 118 of the lower rod 112. The upper-most openings of the set of openings 108 are those nearest the first end 104 and nearest the ceiling fan hanger assembly 12. The set of fasteners 115 can be inserted through the upper-most openings of the set of openings 108 into the set of openings 118. Additionally, and alternatively, the set of fasteners 115 can be set screws that extend through the set of openings 108 and press against the wall 113 of the lower rod 112 to secure the upper and lower rods 102, 112 together. In one non-limiting example, the openings 118 in the lower rod 112 can be threaded such that the fasteners 115 can protrude through the upper rod 102 and screw into the lower rod 112 to hold the upper and lower rods 102, 112 in place. The fasteners 115 do not protrude all the way through the interior of the lower rod 112 to allow cables and/or wiring such as safety cable 120 and electrical wire 130 to move freely within the interior 111. In other words, the fasteners 115 do not span the width of the hollow interior of the rods 102, 112. In the collapsed configuration, the downrod 14 is shortest in length.

Figure 5:
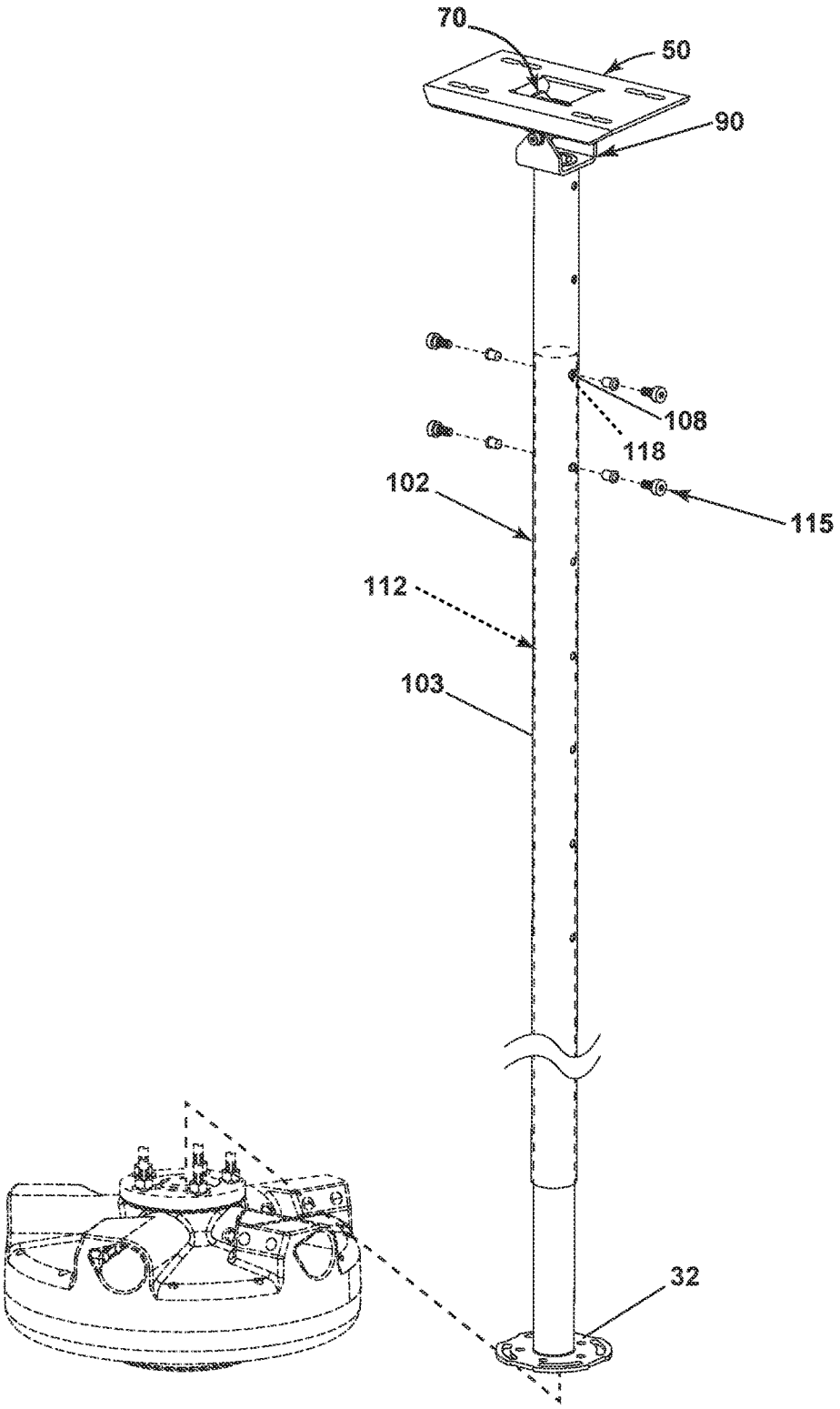
FIG. 5 is a view of the downrod of FIG. 1 in a second configuration.

Turning now to FIG. 5, the downrod 14 is shown in an intermediate expanded configuration, where the upper rod 102 and the lower rod 112 are secured together with fasteners 115 in intermediate openings of the sets of openings 108 and the set of openings 118. In other words, the intermediate openings are any of the set of openings 108 that are not the upper-most openings or the lower-most openings along upper rod 102. It should be appreciated that the upper and lower rods 102, 112 can be secured together by fasteners 115 in any combination of the sets of outer and inner openings 108, 118. For example, the downrod 14 can be in a fully extended configuration when fasteners 115 are placed in the lower-most openings of the set of openings 108 and the set of openings 118. In the fully-extended configuration, the downrod 14 is in its longest configuration.

Figure 6:
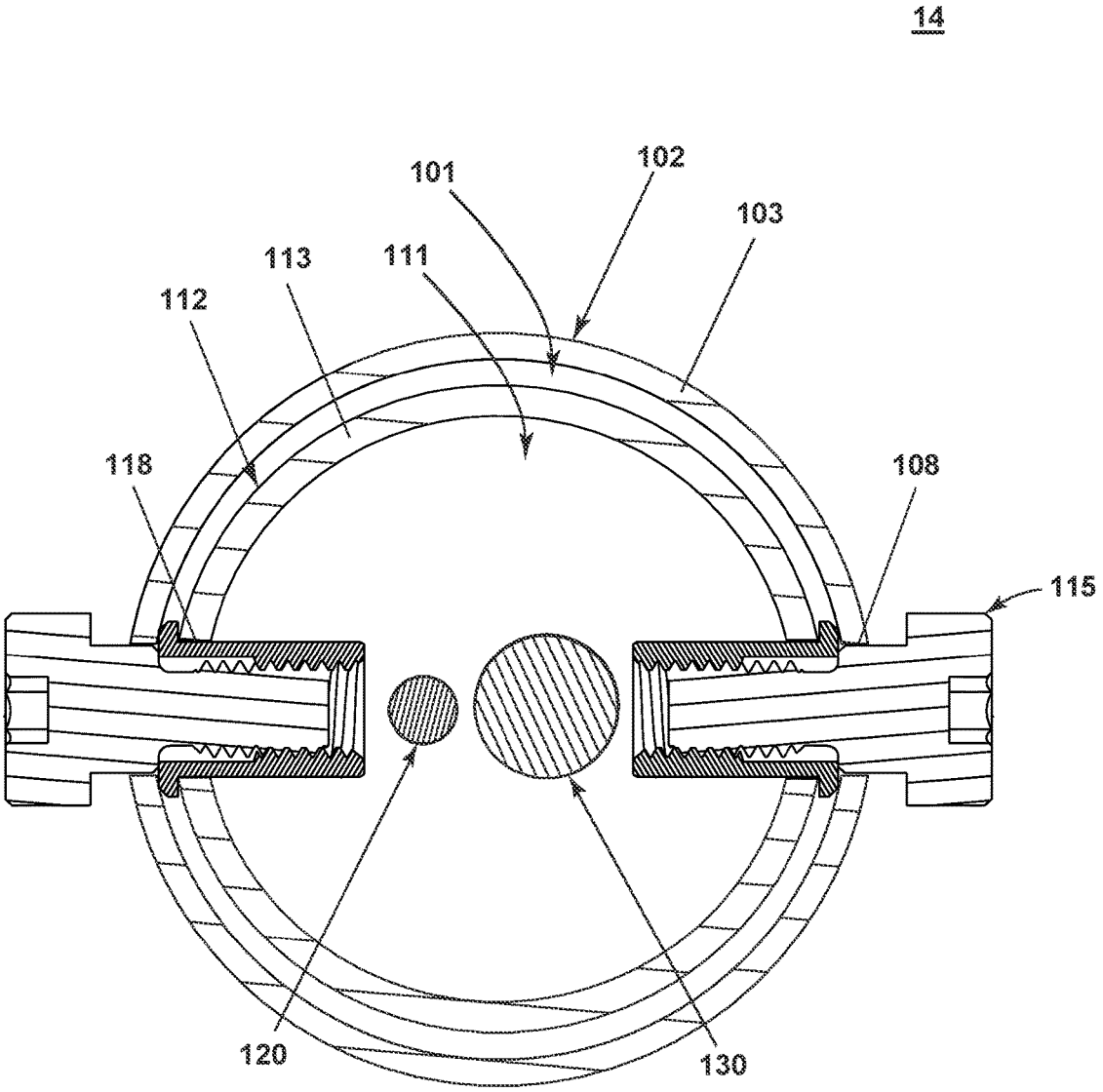
FIG. 6 is a sectional view of the downrod taken through a pair of fasteners.

Referring now to FIG. 6, the sectional view of the assembled downrod 14 shows the arrangement of the upper and lower rods 102, 112 with the set of fasteners 115 in the sets of outer and inner openings 108, 118. The sets of outer and inner openings 108, 118 can be aligned to receive the set of fasteners 115 as pairs. The pairs of fasteners 115 can be positioned on opposite sides of the upper and lower rods 102, 112. In one non-limiting example, the set of fastener pairs do not extend through the center of the downrod 14. In another non-limiting example, the inner opening can include a nut that receives a screw inserted through one of the set of outer openings. The upper rod 102 and lower rod 112 are secured together by fasteners in pairs arranged opposite one another. In other words, at least two screws can extend through the openings of the upper rod 102 and screw into the openings of the lower rod 112 to secure the upper and lower rods 102, 112 relative to one another. The screw/nut can extend partially into the interior of the downrod 14.

Figure 7:
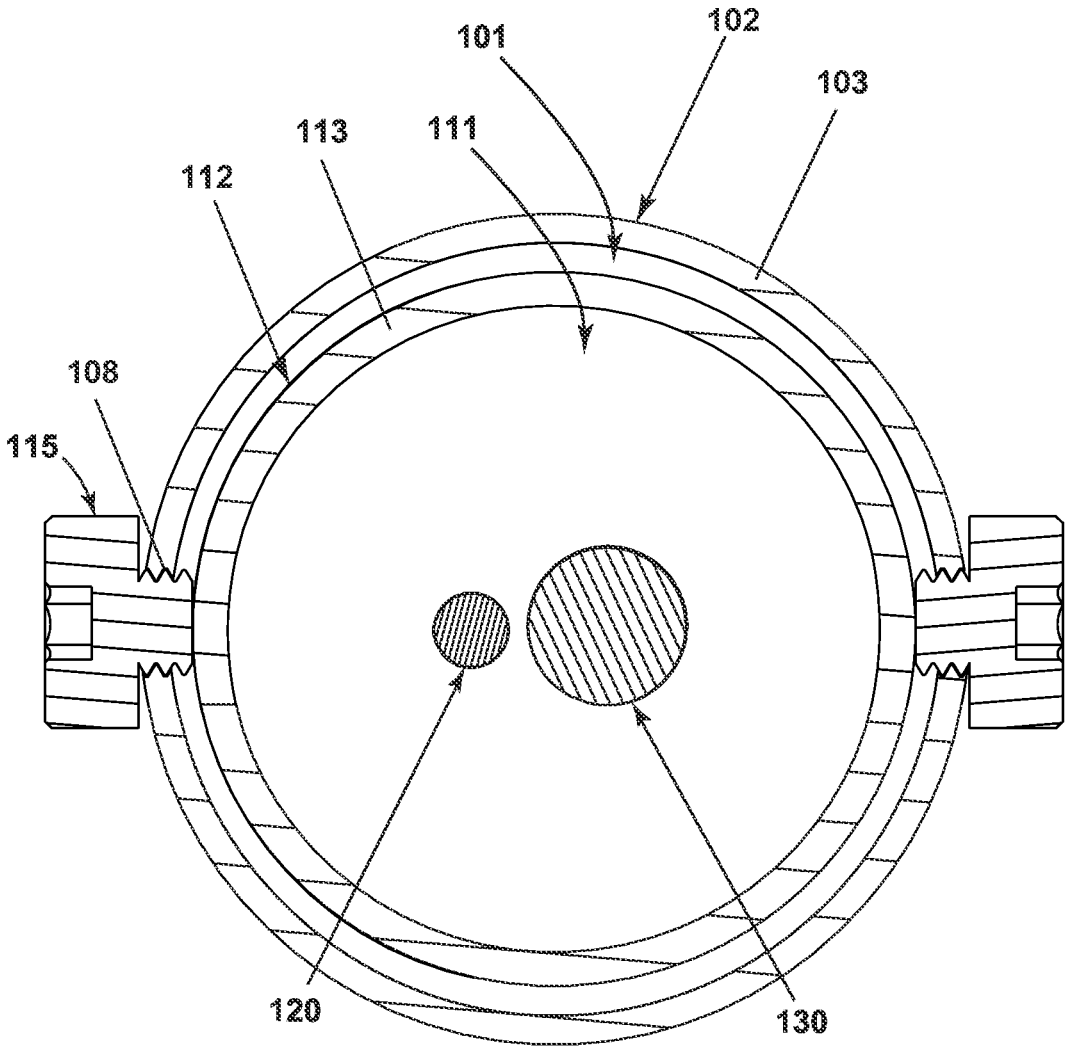
FIG. 7 is a sectional view of the downrod taken through another type of fastener, according to an aspect of the disclosure herein.

Additionally, and alternatively, as shown in FIG. 7, the set of fasteners 115 can extend through the openings 108 of the upper rod 102 and compress against the wall 113 of lower rod 112. The compression of the fastener can thus secure the upper and lower rods 102, 112 relative to one another without the fasteners 115 extending into the interior of the downrod 14. In another non-limiting example, the set of fasteners 115 can extend through the openings 118 of the lower rod 112 and compress against the wall 103 of upper rod 102. The safety cable and the electrical wire can pass through the interior of the downrod 14 without contacting the set of fastener pairs.

In assembling the ceiling fan hanger assembly 12, the connector bracket 70 can be inserted between the plate extensions 62 of the mount plate 50. The upper openings 82 positioned in the tab 80 adjacent the top edge 76 of the connector bracket 70 are aligned adjacent to the apertures 64 in the plate extensions 62. The rounded fasteners 65 can be provided through the aligned upper openings 82 and the apertures 64 to mount the connector bracket 70 to the mount plate 50. In this way, the connector bracket 70 couples to the mount plate 50 at the plate extensions 62 at two opposing sidewalls 74 of the connector bracket 70.

The downrod mount 90 of the downrod 14 can be positioned with the downrod extensions 94 on opposing sidewalls 74 of the connector bracket 70, offset from and unoccupied by the plate extensions 62 already coupled to the connector bracket 70. In this way, the downrod extensions 94 are positioned along the remaining, unoccupied sidewalls 74 of the connector bracket 70, and between and perpendicular to the plate extensions 62. The downrod extension apertures 98 in the downrod extensions 94 can align with the lower openings 84 in the connector bracket 70 positioned in the top tabs 80 along the bottom edge 78. The rounded fasteners 65 can be provided through the aligned lower openings 84 and the downrod extension apertures 98 to mount the connector bracket 70 to the downrod mount 90.

The mount plate 50 and the connector bracket 70 are pivotably connected through the fasteners 65 in the apertures 64 and upper openings 82. Similarly, the connector bracket 70 and the downrod mount 90 are pivotably connected through the fasteners in the lower openings 84 and downrod extension apertures 98. In this way, the downrod mount 90, and therefore the downrod 14 and ultimately the remainder of the hanging ceiling fan 10, can pivot relative to the connector bracket 70.

The downrod 14 is connected at one end to the downrod mount 90 and at one end to the adapter plate 32 of the motor assembly 16. The upper rod 102 is connected at the first end 104 at the bushing 96, which can extend through the bottom wall 92 into the interior 101 of the upper rod 102 and form an interference fit.

The lower rod 112 can be slideable relative to the upper rod 102 in a telescoping manner. The upper and lower rods 102, 112 can be arranged by sliding to have a specified length as desired by the user and fixed with fasteners 115. The length of the downrod 14 can be adjusted by sliding the lower rod 112 within the upper rod 102 to a desired length, aligning the set of outer and inner openings 108, 118, and inserting the fasteners 115.

The safety cable 120 and the electrical wire 130 can be threaded through the interior 111 of the lower rod 112 and also through the interior 101 of the upper rod 102. The safety cable 120 can be secured to the motor assembly by any suitable means, such as by the clevis 124 with a clevis pin through a rod that is inserted in the center of the motor (not shown). The other end of the safety cable 120 can be secured to the structure by any reasonable means, such as cable clamps. During installation, the set of fastener pairs do not impede or interrupt the cable and/or the wire as it is being threaded through the interior of the lower tube allowing or easier installation of ceiling fan.

To the extent not already described, the different features and structures of the various embodiments of the present disclosure may be used in combination with each other as desired.

The telescoping downrod 14 allows the user to suspend the ceiling fan 10 from the ceiling or structure at a specific desired height. The height can be adjusted if necessary in height intervals, or by any amount. The height adjustment intervals can be limited by the spacing of the openings 108,118. Alternatively, if fasteners 115 are set screws, only one of openings 108,118 is needed as the set screw can fix the upper and lower rods together by compression. The fasteners do not contact or otherwise interfere with the safety cable and electrical wire running through the downrod 14, reducing any abrasive contact and improving the longevity of the safety cable and electrical wire and the ceiling fan 10.

The telescoping arrangement of the downrod allows the length of the downrod to be altered as needed during and after installation. For example, if a user wishes to move the ceiling fan to a different room having a different ceiling height, the downrod length can be changed accordingly by removing the fasteners, adjusting the telescoped length of the rods, and securing with the fasteners. Further, because the fasteners do not span across the whole width of the downrod, the safety cable and/or electric wires do not contact the fasteners. Thus, the safety cable and/or electric wires can freely move through the interior of the tubes uninterrupted and untouched.

While aspects of the present disclosure have been specifically described in connection with certain specific embodiments thereof, it is to be understood that this is by way of illustration and not of limitation. Reasonable variation and modification are possible within the scope of the forgoing disclosure and drawings without departing from the spirit of the present disclosure, which is defined in the appended claims.

This written description uses examples to disclose the invention, including the best mode, and to enable any person skilled in the art to practice the invention, including making and using any devices or systems and performing any incorporated methods. The patentable scope of the invention is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

Further aspects of the disclosure are defined by the following clauses:

A ceiling fan assembly comprising: a ceiling mount structure, a motor assembly having a rotating blade hub, and an adjustable downrod assembly connecting the motor assembly to the ceiling mount structure, the adjustable downrod assembly comprising: an upper rod connected to the ceiling mount structure, a lower rod connected to the motor assembly and configured to telescopingly slide relative to the upper rod, and at least two fasteners positioned around the periphery of one of the upper or lower rods and configured to secure the upper rod to the lower rod.

The ceiling fan assembly of any preceding clause, wherein the upper and lower rods are hollow.

The ceiling fan assembly of any preceding clause, further comprising a safety cable connected at one end to the motor assembly and extending unobstructed through the upper and lower rods.

The ceiling fan assembly of any preceding clause, further comprising an electrical wire connected at one end to the motor assembly and extending unobstructed through the upper and lower rods.

The ceiling fan assembly of any preceding clause, wherein the at least two fasteners comprise screws.

The ceiling fan assembly of any preceding clause, wherein the screws are set screws.

The ceiling fan assembly of any preceding clause, wherein the at least two set screws extend through one of the upper and lower rods and compress against the other of the upper and lower rods to secure the rods relative to one another.

The ceiling fan assembly of any preceding clause, wherein the at least two screws extend through one of the upper or lower rod and screw into the other of the upper or lower rod to secure the rods relative to one another.

The ceiling fan assembly of any preceding clause, wherein the at least two screws do not extend through a center of the upper and lower rods.

The ceiling fan assembly of any preceding clause, wherein the at least two fasteners are positioned on opposing sides of the one of the upper or lower rods.

The ceiling fan assembly of any preceding clause, wherein the at least two fasteners comprises 4 fasteners.

A ceiling fan assembly comprising: a ceiling mount structure, a motor assembly having a rotating blade hub, and a downrod assembly comprising a telescoping rod having a hollow interior connecting the motor assembly to the ceiling mount structure and at least two fasteners positioned around the periphery of the telescoping rod to secure the telescoping rod in a fixed position.

The ceiling fan assembly of any preceding clause, wherein the at least two fasteners do not extend into the hollow interior.

The ceiling fan assembly of any preceding clause, wherein the telescoping rod comprises a first rod and a second rod slideable relative to the first rod.

The ceiling fan assembly of any preceding clause, wherein the at least two fasteners do not extend through a center of the telescoping rod.

The ceiling fan assembly of any preceding clause, further comprising an electrical wire connected at one end to the motor assembly and extending unobstructed through the telescoping rod.

The ceiling fan assembly of any preceding clause, further comprising a safety cable connected at one end to the motor assembly and extending unobstructed through the telescoping rod.

The ceiling fan assembly of any preceding clause, wherein the at least two fasteners are positioned on opposing sides of the telescoping rod.

The ceiling fan assembly of any preceding clause, wherein the telescoping rod comprises a third rod slideable relative to the first rod and second rod.

The ceiling fan assembly of any preceding clause, wherein the at least two fasteners extend through two of the first rod, second rod, or third rod and secure the rods relative to one another.

What is claimed is:

1. A ceiling fan assembly comprising:

a ceiling mount structure;

a motor having a rotating blade hub;

an adapter assembly connected to the motor;

an adjustable downrod assembly connecting the adapter assembly to the ceiling mount structure, the adjustable downrod assembly comprising:

an upper rod connected to the ceiling mount structure and having a hollow interior;

a lower rod connected to the adapter assembly and configured to telescopingly slide relative to the upper rod and having a hollow interior;

at least two fasteners positioned around the periphery of one of the upper or lower rods and configured to secure the upper rod to the lower rod;

wherein at least a portion of one of the upper and lower rods is received within the hollow interior of the other of the upper and lower rods to correspondingly define an inner rod and outer rod, the inner rod comprises at least two nuts, and the at least two fasteners pass through the outer rod and thread into a corresponding one of the at least two nuts without passing entirely through the hollow interior of either the upper or lower rod.

2. The ceiling fan assembly of claim 1, wherein the upper and lower rods are hollow.

3. The ceiling fan assembly of claim 2, further comprising a safety cable connected at one end to the motor and extending unobstructed through the upper and lower rods.

4. The ceiling fan assembly of claim 2, further comprising an electrical wire connected at one end to the motor and extending unobstructed through the upper and lower rods.

5. The ceiling fan assembly of claim 1, wherein the at least two fasteners comprise screws.

6. The ceiling fan assembly of claim 5, wherein the screws are set screws.

7. The ceiling fan assembly of claim 1, wherein the at least two fasteners are positioned on opposing sides of the one of the upper or lower rods.

8. The ceiling fan assembly of claim 7, wherein the at least two fasteners comprises 4 fasteners.

9. The ceiling fan assembly of claim 1, further comprising an electrical wire connected at one end to the motor and extending unobstructed through the adapter assembly and the telescoping rod.

10. The ceiling fan assembly of claim 1, further comprising a safety cable connected at one end to the motor and extending unobstructed through the adapter assembly and the telescoping rod.

* * * * *